US009643627B2

(12) United States Patent
Benkert

(10) Patent No.: US 9,643,627 B2
(45) Date of Patent: May 9, 2017

(54) METHOD FOR OPERATING A MOBILE DEVICE IN A RAILWAY SYSTEM, RAILWAY SYSTEM AND MOBILE DEVICE

(71) Applicant: SIEMENS AKTIENGESELLSCHAFT, Munich (DE)

(72) Inventor: Michael Benkert, Burgdorf (DE)

(73) Assignee: Siemens Aktiengesellschaft, Munich (DE)

( * ) Notice: Subject to any disclaimer, the term of this patent is extended or adjusted under 35 U.S.C. 154(b) by 175 days.

(21) Appl. No.: 14/431,393

(22) PCT Filed: Sep. 10, 2013

(86) PCT No.: PCT/EP2013/068655
§ 371 (c)(1),
(2) Date: Mar. 26, 2015

(87) PCT Pub. No.: WO2014/048714
PCT Pub. Date: Apr. 3, 2014

(65) Prior Publication Data

US 2015/0251674 A1 Sep. 10, 2015

(30) Foreign Application Priority Data

Sep. 27, 2012 (DE) ..... 10 2012 217 620

(51) Int. Cl.
*B61L 25/02* (2006.01)
*B61L 25/04* (2006.01)
(Continued)

(52) U.S. Cl.
CPC ..... *B61L 25/02* (2013.01); *B61L 1/02* (2013.01); *B61L 25/04* (2013.01); *B61L 3/065* (2013.01)

(58) Field of Classification Search
CPC ..... B61L 25/021; B61L 27/0088; B61L 27/0005; B61L 23/00; B61L 27/0077;
(Continued)

(56) References Cited

U.S. PATENT DOCUMENTS 3,502,851 A 3/1970 Kakimoto et al.
6,216,985 B1 * 4/2001 Stephens ..... B61K 9/10 246/120
(Continued)

FOREIGN PATENT DOCUMENTS

CN 1812907 A 8/2006
CN 102673469 A 9/2012
(Continued)

*Primary Examiner* — Mark Le
(74) *Attorney, Agent, or Firm* — Laurence Greenberg; Werner Stemer; Ralph Locher

(57) ABSTRACT

A method operates a mobile device in a railway system with at least one optical waveguide which is laid next to at least one railway track and into which light pulses are fed. The optical waveguide is used as a distributed acoustic sensor and detects scattered-back light. In order to be able to identify reliably such a mobile device in a comparatively easy way, the mobile device is provided with a sound generator which can be adjusted with respect to its frequency spectrum in a way which designates the mobile device. The sound generator is adjusted with respect to its frequency spectrum in a way which designates the mobile device by assigning a frequency selection to the mobile device. An identification number signal of the mobile device is acquired by detecting the scattered-back light from the detected frequency selection. A railway system having such a mobile device is also taught.

12 Claims, 2 Drawing Sheets

(51) Int. Cl.
*B61L 1/02* (2006.01)
*B61L 3/06* (2006.01)

(58) Field of Classification Search
CPC .... B61L 27/0094; B61L 15/0018; B61L 1/02; B61L 25/02; B61L 25/04; B61L 3/065; G01H 9/004
See application file for complete search history.

(56) References Cited

U.S. PATENT DOCUMENTS 6,830,224 B2 * 12/2004 Lewin ..... B61L 23/041 246/167 R
6,951,132 B2 10/2005 Davenport et al.
7,664,459 B2 * 2/2010 Smith, Jr. ..... B61L 15/0027 246/167 R
7,770,847 B1 * 8/2010 Severson ..... A63H 19/24 246/1 C
2005/0271317 A1 * 12/2005 Taverner ..... G01D 5/35358 385/12
2012/0074266 A1 3/2012 Daum et al.
2012/0217351 A1 8/2012 Chadwick et al.
2012/0229267 A1 9/2012 Nakayama
2014/0362668 A1 * 12/2014 McEwen-King ..... G01H 9/004 367/118
2015/0000415 A1 1/2015 Kelley
2015/0274182 A1 * 10/2015 Arpaci ..... B61L 3/065 246/63 R

FOREIGN PATENT DOCUMENTS

DE 1530336 A1 3/1970
DE 19940549 C1 1/2001
DE 10240272 A1 5/2003
DE 10240272 A9 12/2005
EP 2056492 A1 5/2009
WO 2011027166 A1 3/2011
WO WO 2011/027166 * 3/2011
WO 2013114129 A1 8/2013

* cited by examiner

METHOD FOR OPERATING A MOBILE DEVICE IN A RAILWAY SYSTEM, RAILWAY SYSTEM AND MOBILE DEVICE

BACKGROUND OF THE INVENTION

Field of the Invention

The invention relates to a method for operating a mobile device in a railway system with at least one optical waveguide which is laid next to at least one railway track, with the optical waveguide being used as a distributed acoustic sensor into which light pulses are fed, and back-scattered light is detected.

A method of this type is described in international patent application WO 211/027166 A1. In this known method, a rail vehicle is identified on a railway track in that the motion noise typical of each rail vehicle is determined by means of an optical waveguide laid next to the railway track. For this purpose light is fed into the optical waveguide and back-scattered light is detected. This back-scattered light has a frequency distribution that corresponds to that of the noise produced by the rail vehicle traveling alongside the optical waveguide. If the motion noise of the rail vehicle or its frequency spectrum is known and stored, it is possible to identify the rail vehicle on the railway track by comparing the spectrum of the rail vehicle with the stored frequency spectrum. It is also possible to differentiate rail vehicles if their motion noise has different frequency spectra, which is usually the case.

BRIEF SUMMARY OF THE INVENTION

The object of the invention is to propose a method for operating a mobile device in a railway system with which it is possible not only to identify a mobile device comparatively easily, but also in a particularly reliable manner.

To achieve this object, in a method of the type mentioned in the introduction, according to the invention a mobile device having a sound generator which can be adjusted with respect to its frequency spectrum in a way which designates a device is used, and the sound generator is adjusted with respect to its frequency spectrum in a way which designates a device by assigning a frequency selection to the mobile device; an identification number signal of the mobile device is acquired by detecting the back-scattered light from the detected frequency selection.

A significant advantage of the method according to the invention is that using an adjustable sound generator on the mobile device makes it possible to individually adjust the frequency spectrum of the sound generator of the mobile device and also of each individual sound generator of mobile devices in a railway track system; every mobile device is therefore designated with a frequency spectrum via its sound generator; the frequency spectra or the identification number signals respectively are managed by the railway system. When operating a mobile device in a railway system in accordance with the method according to the invention, it is therefore not necessary to determine in advance the frequency spectrum of a mobile device as it is necessary to do with the known method. With the method according to the invention, it is relatively simple to allocate to the mobile device an identification number in the form of an individually assigned frequency spectrum and to acquire from the back-scattered light an identification number signal for evaluation with respect to identifying the mobile device.

The method according to the invention may be advantageously developed in that, in the case of a device associated with a type class of mobile devices, the sound generator is adjusted with respect to its frequency spectrum in a way which designates a type class by assigning a further frequency selection to the mobile device and a classification signal of the mobile device is acquired by detecting the back-scattered light from the detected further frequency selection. By assigning a further frequency selection to the mobile device, it is namely possible, in addition to identification by means of an identification number signal, also to indicate a type class of the respective mobile device and consequently make the identification of the mobile device particularly reliable.

The frequency spectrum of the sound generator may be adjusted in different ways; for instance it is considered advantageous if a sound generator having a manually adjustable frequency spectrum is used, so that the sound generator can be adjusted locally. Said frequency spectrum can be specified by a control center of the railway system, and is consequently also known to the control center, so that it is also possible to reliably identify and classify a mobile device with a sound generator adjusted in this way.

It is considered particularly advantageous if the frequency spectrum of the sound generator is adjusted by a central frequency spectrum selection module, for example via a radio or wired connection. In this case, the frequency spectrum can be selected from the mobile device or centrally in the central frequency spectrum selection module and assigned to the sound generator.

With the method according to the invention it is possible—as already described above—to identify a mobile device in a railway system. It is therefore considered advantageous if equipment for train control, train protection and/or train supervision receives the identification number signal and/or the classification signal, because both the identification number signal and the classification signal are ideally suited for train control and train protection, as well as for train supervision.

Different mobile equipment of a railway system may be used as the mobile device. A preferred application is a mobile device in the form of a rail vehicle because this makes it possible to simply and reliably identify, and if necessary also locate, a rail vehicle within the scope of the method according to the invention. No further technical signaling communication equipment is required. The number of axle counters, balises etc. along the railway track can be greatly reduced.

It is however also possible to use a mobile signaling device as the mobile device. According to the invention, such a mobile signaling device then outputs an identification number signal, and possibly also a classification signal, which can be used to reliably control the operation of the railway system even in the event of disruptions or disturbances on the tracks—usually indicated by mobile signaling devices.

Preferred mobile signaling equipment is equipment for controlling and influencing rail traffic, for instance a track blocking signaling device and a speed restriction section signaling device.

The invention further relates to a railway system having next to at least one railway track at least one optical waveguide as a distributed acoustic sensor, to which a light emitting and evaluation unit containing optical transmitters and optical receivers for back-scattered light is assigned, as is also known from the international patent application cited above.

To further develop such a railway system so that a mobile device can be identified in a comparatively simple and reliable way, according to the invention the railway system includes at least one mobile device having a sound generator which can be adjusted with respect to its frequency spectrum in a way which designates a device; the sound generator is communicatively connected to a frequency spectrum selection module for assigning a frequency selection to the mobile device, and the light emitting and evaluation unit is designed in such a way that it can detect the frequency selection from the back-scattered light and acquire from that an identification number signal of the mobile device.

The same advantages may likewise be achieved with this railway system as have been stated above in the description of the method according to the invention.

In order to identify mobile devices advantageously also with respect to their type class in the railway system according to the invention, in accordance with a further development of the railway system according to the invention, in the case of a mobile device associated with a type class of mobile devices, the sound generator is adjusted with respect to its frequency spectrum in a way which designates a type class by assigning a further frequency selection to the mobile device, and the light emitting and evaluation unit is designed in such a way that it can detect the further frequency selection from the back-scattered light and acquire from that a classification signal of the mobile device.

A mobile device may be identified particularly reliably with this embodiment of the railway system according to the invention.

In the railway system according to the invention, the frequency spectrum of the sound generator may be adjusted in different ways; one advantageous embodiment includes a sound generator which is connected to a manual frequency spectrum adjustment device.

It is also advantageous, however, if the sound generator is communicatively connected to a central frequency spectrum selection module. The communicative connection of the sound generator to the central frequency selection module may be implemented here by means of both a wired and a radio connection; connection is also possible by means of optical links.

In the railway system according to the invention, the light emitting and evaluation unit is advantageously communicatively connected to equipment for train control, train protection and/or train supervision. Here, too, the connection may be wired, wireless or via optical media.

In the railway system according to the invention, the mobile device is preferably a rail vehicle, because rail vehicles frequently require reliable identification when operating in a railway system. Within the scope of the railway system according to the invention, however, the mobile device may also be a mobile signaling device, which is preferably understood to refer to a track blocking signaling device or to a speed restriction section signaling device. According to the invention, said signaling devices are thus incorporated in the railway system in a simple way and can be used for controlling and influencing trains.

The invention furthermore relates to a mobile device of a railway system having a sound generator which can be adjusted with respect to its frequency spectrum in a way which designates a device, in that a frequency selection can be assigned to the mobile device. With such a mobile device, it is simple to identify it even if the mobile device does not generate its own specific noises.

In the mobile device according to the invention, the sound generator can advantageously be connected to a frequency spectrum selection module that forms one constructional unit with the sound generator; this arrangement enables the frequency selection to be adjusted locally.

It has also proved advantageous if, in the case of a mobile device associated with a type class of mobile devices, the sound generator is designed in such a way that it can be adjusted with respect to its frequency spectrum in a way which designates a type class by assigning a further frequency selection to the mobile device.

In one preferred embodiment of the device according to the invention, said device is a rail vehicle. It may however also be advantageous if the device is a mobile signaling device. This may in turn be designed as a track blocking signaling device or as a speed restriction section signaling device.

BRIEF DESCRIPTION OF THE SEVERAL VIEWS OF THE DRAWING

In order to illustrate the invention further.

DESCRIPTION OF THE INVENTION

Figure 1:
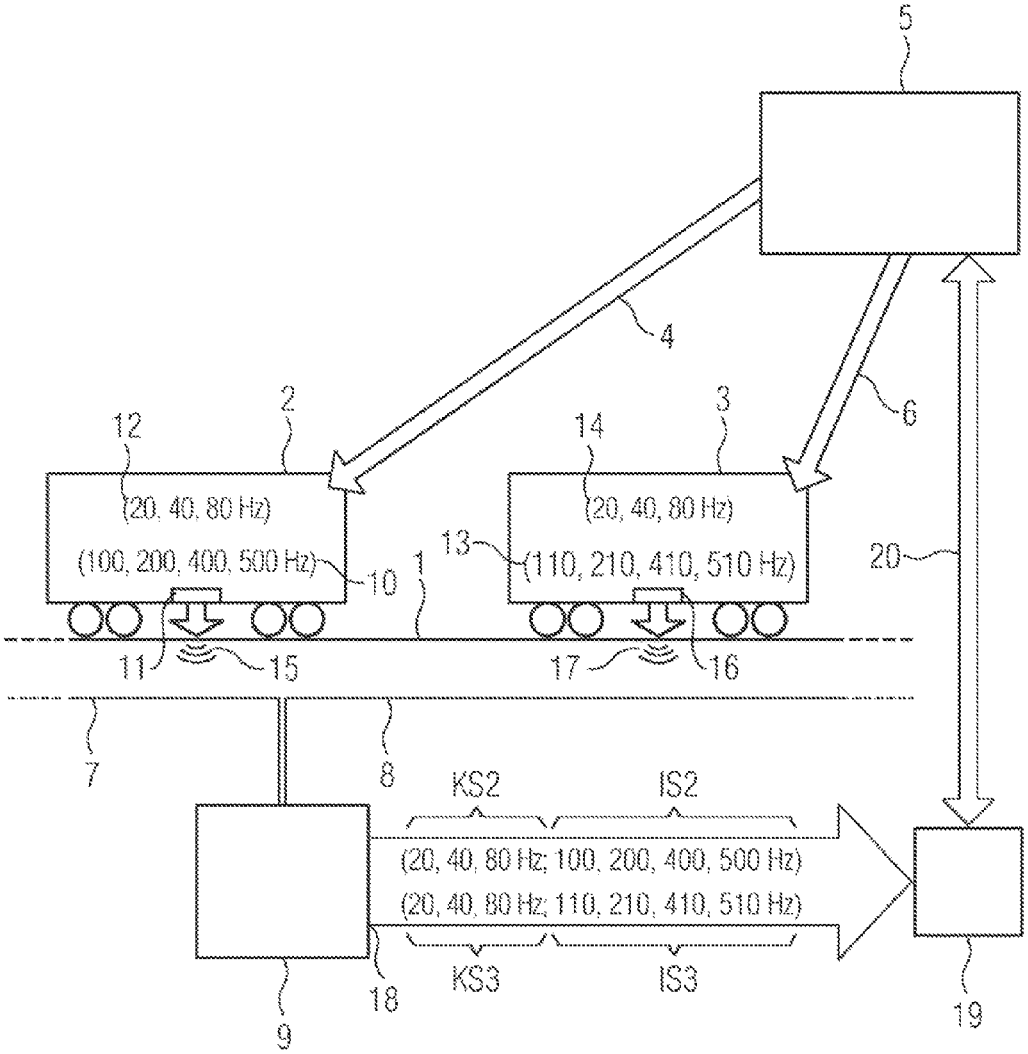
FIG. 1 shows a schematic diagram of an exemplary embodiment of the railway system according to the invention with two mobile devices designed as rail vehicles.

The exemplary embodiment as shown in FIG. 1 shows a railway track 1, on which a first mobile device in the form of a rail vehicle 2 and a further mobile device in the form of a further rail vehicle 3 are present. The rail vehicle 2 is connected via a communications link 4 to a frequency spectrum selection module 5 in a control center, not shown, of the railway system depicted; the further rail vehicle 3 is likewise connected to the frequency spectrum selection module 5 via a further communications link 6.

Laid next to the railway track 1 is an optical waveguide 7 and a further optical waveguide 8. The two optical waveguides 7 and 8 are connected to a light emitting and evaluation unit 9, in which, inter alia, an optical transmitter and an optical receiver are integrated in a manner not illustrated. Light pulses are thus emitted by the light emitting and evaluation unit 9 into the optical waveguides 7 and 8, and back-scattered light is also detected by means of an optical receiver—likewise not shown—and is subject to a frequency selection determination.

As FIG. 1 further indicates, the rail vehicle 2 is equipped in such a way that it determines the frequencies assigned by the frequency spectrum selection module 5 and includes as frequency spectrum, for example, a frequency selection 10 which comprises the frequencies 100, 200, 400 and 500 Hz. Said frequency selection 10 also constitutes an identification number for the rail vehicle 2. A further frequency selection 12, comprising the frequencies 20, 40, 80 Hz, is also assigned to the rail vehicle 2, or to its sound generator 11 respectively, which enables a classification regarding, for example, whether the rail vehicle is a passenger train or a goods train.

Analogously, the further rail vehicle 3 receives a frequency selection 13 which comprises frequencies 110, 210, 410 and 510 Hz and constitutes an identification number for the further rail vehicle 3. This identification number differs from that of the first rail vehicle 2. Since in the present example the rail vehicle 3 is likewise of the same type as the further rail vehicle 3, the latter also receives a further frequency selection 14 comprising the frequencies 20, 40 and 80 Hz corresponding to the rail vehicle 2.

When the rail vehicles 2 are moving, the sound generator 11 of the rail vehicle 2 transmits sound waves 15 with a frequency spectrum which comprises the frequencies of the one frequency selection 10 and of the further frequency selection 12; a sound generator 16 of the further rail vehicle 3 transmits sound waves 17 having the frequencies of the frequency selections 13 and 14.

Said sound waves 15 and 17 influence the light passing through the optical waveguides 7 and 8 in such a way that a back-scattering of light occurs at the respective points where the sound waves 15 and 17 arrive at the optical waveguides 7 and 8. The frequency spectrum of this light is not identical to the light output by the sound generators 11 and 16, so that corresponding electrical signals are generated by the light emitting and evaluation unit 9 and made available at its output 18. A signal is an electrical identification number signal IS2 which is formed from the detected back-scattered light with frequencies of 100, 200, 400 and 500 Hz of the sound generator 11 of the one rail vehicle 2. Likewise, an electrical classification signal KS2 with frequencies of 20, 40 and 80 Hz is formed which in the exemplary embodiment illustrated is transmitted together with the identification number signal IS2 to a train protection system 19. Analogously, a further identification signal IS3 is generated in the light emitting and evaluation unit 9 as a result of detection from the back-scattered light in the optical waveguide 8. A classification signal KS3 is also transmitted at the output 18 of the light emitting and evaluation unit 9 with respect to the sound waves 17 output by the sound generator 16 of the further rail vehicle 3.

As FIG. 1 furthermore shows, there is a bidirectional communications link 20 between the train protection system 19 and the frequency spectrum selection module 5, via which link the frequency spectra transmitted to the rail vehicles 2 and 3 are also notified to the train protection system 19 so that it is able to identify the respective rail vehicles 2 and 3 by comparing the transmitted frequency spectra with the frequency spectra determined by means of the optical waveguides 7 and 8.

Figure 2:
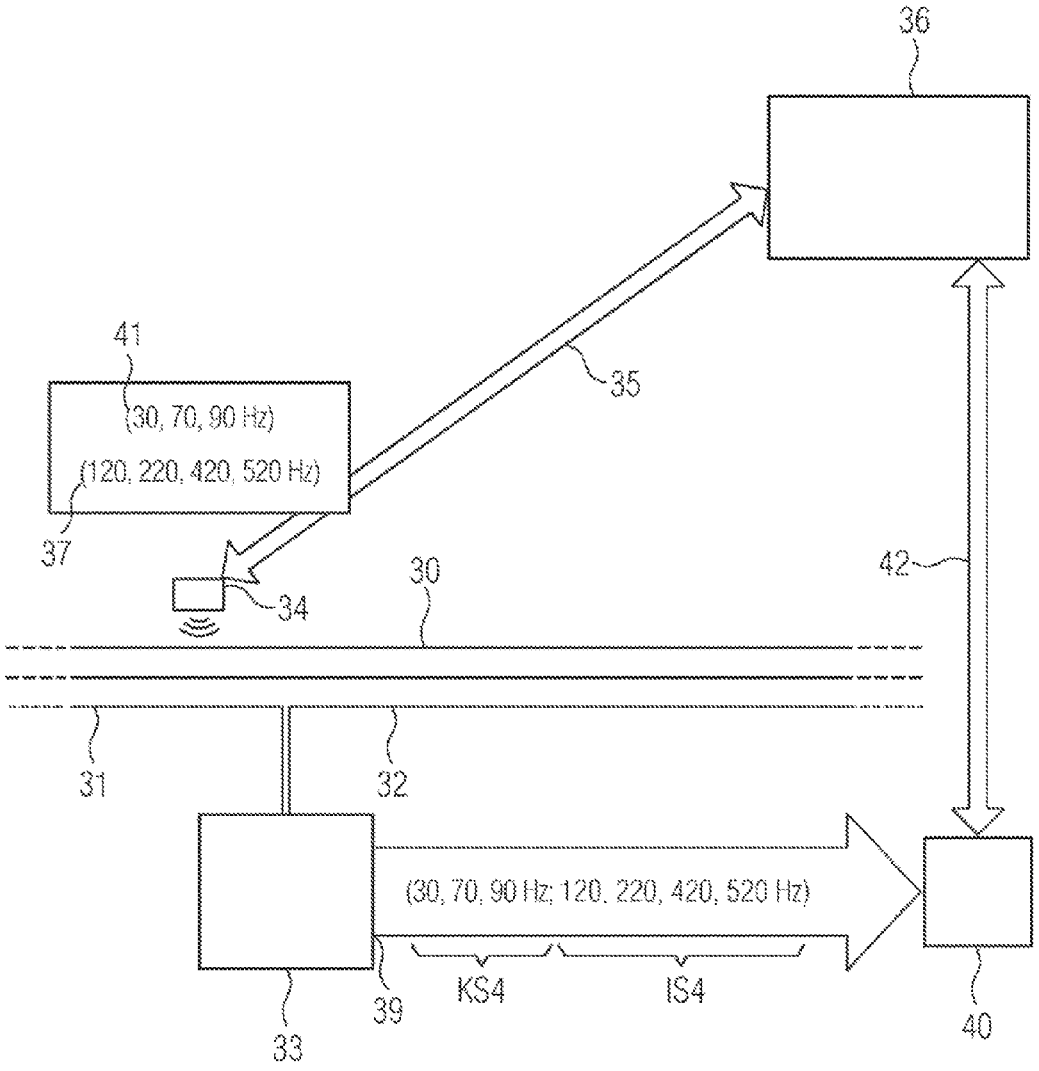
FIG. 2 shows a further exemplary embodiment with a mobile device in the form of a mobile signaling device.

In the exemplary embodiment as shown in FIG. 2 there is likewise a railway track 30, parallel to which a first optical waveguide 31 and, connected to that, a further optical waveguide 32 are laid. Both optical waveguides 31 and 32 are connected to a light emitting and evaluation unit 33, which corresponds to the arrangement 9 as shown in FIG. 1. In the example illustrated, positioned next to the railway track 30 is a mobile device in the form of a mobile signaling device 34, to which a frequency selection 37 comprising 120, 220, 420 and 520 Hz is assigned via a communications link 35 to a frequency spectrum selection module 36 corresponding to the frequency spectrum selection module 5 as shown in FIG. 1. Said frequency selection 37 causes a sound generator 38 of the mobile device 34 to output sound waves with a corresponding frequency spectrum.

Said sound waves are picked up by the optical waveguide 31 and are processed in the light emitting and evaluation unit 33 in a way such as described in detail in relation to the unit 9 in connection with the description of FIG. 1. The light emitting and evaluation unit 33 thus outputs at its output 39 an identification number signal IS4 whose frequency spectrum matches the assigned frequency selection 37. Said signal IS4 is transmitted to a train protection unit 40.

Analogously, a further frequency selection 41 is assigned to the mobile device 34, or to its sound generator 38 respectively, by the frequency spectrum selection module 36 via the communications link 35, and causes the sound generator 38 to emit a corresponding further frequency selection 41 comprising 30, 70 and 90 Hz. Said frequency selection 41 is determined by means of the optical waveguide 31 and is translated in the light emitting and evaluation unit 33 into a classification signal KS4 with frequencies of 30, 70 and 90 Hz. Said classification signal KS4 is also transmitted to the train protection system 40, which is additionally connected to the frequency spectrum selection module 36 via a communications link 41. The train protection system 40 is thus able to recognize that there is present in the proximity of the optical waveguide 31 a mobile signaling device 34 which, as a track blocking signaling device for instance, is signaling a temporary track block, and it can control the rail traffic accordingly. For this purpose, the train protection system 40 receives information about the frequency selection 37 and 41 from the frequency spectrum selection module 36 via the communications link 42; in addition functions and tasks are assigned to the mobile device 34 via the communications link 42 and the train protection system 40.

The invention claimed is:

1. A method for operating a mobile device in a railway system, the rail system having at least one optical waveguide laid next to at least one railway track, the optical waveguide being used as a distributed acoustic sensor into which light pulses are fed, and back-scattered light is detected, which comprises the steps of:

providing the mobile device with a sound generator which can be adjusted with respect to a frequency spectrum in a way which identifies the mobile device;

adjusting the sound generator with respect to the frequency spectrum in a way which designates the mobile device by assigning a frequency selection to the mobile device; and acquiring an identification number signal of the mobile device by detecting the back-scattered light from a detected frequency selection.

2. The method according to claim 1, wherein:

the mobile device is associated with a type of class of mobile devices, the sound generator is adjusted with respect to the frequency spectrum in a way which designates the type of class by assigning a further frequency selection to the mobile device; and a classification signal of the mobile device is acquired by detecting the back-scattered light from a detected further frequency selection.

3. The method according to claim 1, wherein:

the sound generator has a manually adjustable frequency spectrum; or the frequency spectrum of the sound generator is adjusted by a central frequency spectrum selection module.

4. The method according to claim 2, wherein equipment for train control, train protection and/or train supervision receives at least one of the identification number signal or the classification signal.

5. The method according to claim 1, which further comprises selecting the mobile device from the group consisting of rail vehicles and mobile signaling devices.

6. The method according to claim 5, which further comprises selecting the mobile signaling device from the group consisting of a device for controlling and influencing rail traffic and a speed restriction section signaling device.

7. A railway system, comprising:

at least one railway track;

at least one optical waveguide disposed next to said railway track and functioning as a distributed acoustic sensor;

a light emitting and evaluation unit containing optical transmitters and optical receivers for back-scattered light and coupled to said distributed acoustic sensor;

a frequency spectrum selection module;

at least one mobile device having a sound generator being adjusted with respect to a frequency spectrum in a way which designates said mobile device, said sound generator communicatively connected to said frequency spectrum selection module for assigning a frequency selection to said mobile device; and said light emitting and evaluation unit is configured to detect the frequency selection from the back-scattered light and acquire from the back-scattered light an identification number signal of said mobile device.

8. The railway system according to claim 7, wherein:

said mobile device has a type of class of mobile devices, said sound generator can be adjusted with respect to the frequency spectrum in a way which designates the type of class by assigning a further frequency selection to said mobile device; and said light emitting and evaluation unit is configured to detect the further frequency selection from the back-scattered light and acquire from the back-scattered light a classification signal of said mobile device.

9. The railway system according to claim 7, further comprising a further device selected from the group consisting of a manual frequency spectrum adjustment device and a central frequency spectrum selection module, said sound generator is connected to said further device.

10. The railway system according to claim 7, further comprising equipment for at least one of train control, train protection or train supervision, said light emitting and evaluation unit is communicatively connected to said equipment.

11. The railway system according to claim 7, wherein said mobile device is selected from the group consisting of a rail vehicle and a mobile signaling device.

12. The railway system according to claim 11, wherein said mobile signaling device is a device for controlling and influencing rail traffic or a track blocking signaling device or a speed restriction section signaling device.

* * * * *